US011002522B1

(12) United States Patent
Tagget et al.

(10) Patent No.: US 11,002,522 B1
(45) Date of Patent: May 11, 2021

(54) MECHANICAL BROAD HEADS

(71) Applicants: Steven Tagget, Bridgeport, MI (US); Matthew Tagget, Bridgeport, MI (US)

(72) Inventors: Steven Tagget, Bridgeport, MI (US); Matthew Tagget, Bridgeport, MI (US)

( * ) Notice: Subject to any disclaimer, the term of this patent is extended or adjusted under 35 U.S.C. 154(b) by 0 days.

(21) Appl. No.: 16/736,105

(22) Filed: Jan. 7, 2020

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 4,998,738 A * 3/1991 Puckett ..... F42B 6/08 473/583
5,102,147 A * 4/1992 Szeluga ..... F42B 6/08 473/584
5,112,063 A * 5/1992 Puckett ..... F42B 6/08 473/583
7,713,152 B1 * 5/2010 Tentler ..... F42B 6/08 473/583
7,905,802 B2 * 3/2011 Erhard ..... F42B 6/08 473/583
8,118,694 B1 * 2/2012 Oliveira ..... F42B 6/08 473/583
8,398,510 B1 * 3/2013 Mizek ..... F42B 6/08 473/583
8,449,416 B2 * 5/2013 Grace ..... F42B 6/08 473/583
8,905,874 B2 * 12/2014 Sullivan ..... F42B 12/34 473/583
9,267,773 B2 * 2/2016 Mizek ..... F42B 6/08
10,458,767 B2 * 10/2019 Buchanan ..... F42B 6/08
2015/0184986 A1 * 7/2015 Franco, Sr. ..... F42B 6/08 473/577
2017/0184381 A1 * 6/2017 Loa ..... F42B 6/08
2019/0212112 A1 * 7/2019 Buchanan ..... F42B 6/08

* cited by examiner

*Primary Examiner* — John A Ricci

(57) ABSTRACT

Broad head arrowheads of the type that comprise expanding blades. Such broad heads comprise two blades a tip and a ferrule, each blade having a wing and an aperture, the ferrule comprising a passageway into one end of the ferrule along the longitudinal axis of the ferrule dimensioned to accept a pin having a longitudinal axis transverse to the longitudinal axis of the ferrule so that when the pin is passed through the apertures of the blades and inserted into the passageway into the ferrule, the tip can be fastened to the one end of the ferrule with the blades folded back on the ferrule with the wings of the blades extending from the ferrule so that when the mechanical broad head penetrates a target, the wings of the blades engage with the target causing the blades to swing out from the ferrule on the pin as the pin slides further along the passageway into the ferrule.

1 Claim, 6 Drawing Sheets

MECHANICAL BROAD HEADS

BACKGROUND OF THE INVENTION

The instant invention relates to broad head arrowheads of the type that comprise expanding blades. The art denotes such broad heads as "mechanical broad heads". Broad head arrowheads are known and comprise either fixed or expandable blades. Fixed blade broad heads are mechanically simple but suffer from relatively high aerodynamic drag from the exposed fixed blades. U.S. Pat. Nos. 5,102,147 and 8,118,694 disclose other broad heads having fully retracting blades. U.S. Pat. Nos. 7,713,152; 7,905,802; 8,905,874; and US Patent Application Publication 2015/0184986 disclose broad heads having partially retracting blades. Despite the above-mentioned advancements in the art of mechanical broad heads, there remains a need for a mechanical broad head having a better balance of reliability, lower cost, versatility and ruggedness factors.

THE INVENTION

The instant invention is the discovery of unique mechanical broad heads. The mechanical broad heads of the instant invention have a better balance of reliability, lower cost, versatility and ruggedness factors than prior art mechanical broad heads and use a rubber O-ring to retain the blades in position. More specifically in one embodiment, the instant invention provides mechanical broad heads, comprising: two blades a tip and a ferrule, each blade having a wing and an aperture, the ferrule comprising a passageway into one end of the ferrule along the longitudinal axis of the ferrule dimensioned to accept a pin having a longitudinal axis transverse to the longitudinal axis of the ferrule so that when the pin is passed through the apertures of the blades and inserted into the passageway into the ferrule, the tip can be fastened to the one end of the ferrule with the blades folded back on the ferrule with the wings of the blades extending from the ferrule so that when the mechanical broad head penetrates a target, the wings of the blades engage with the target causing the blades to swing out from the ferrule on the pin as the pin slides further along the passageway into the ferrule.

In another embodiment, there is a mechanical broad head wherein the blades are retained by a spring lock retainer. The broad head comprises two blades a tip and a ferrule, each blade having a wing and an aperture. The ferrule comprises a passageway into one end of the ferrule along the longitudinal axis of the ferrule dimensioned to accept a pin having a longitudinal axis transverse to the longitudinal axis of the ferrule so that when the pin is passed through the apertures of the blades and inserted into the passageway into the ferrule, the tip can be fastened to the one end of the ferrule with the blades folded back on the ferrule with the wings of the blades extending from the ferrule so that when the mechanical broad head penetrates a target, the wings of the blades engage with the target causing the blades to swing out from the ferrule on the pin as the pin slides further into the ferrule in the passageway into the ferrule. This mechanical broad head further comprises a spring lock retainer to retain the blades folded back on the ferrule with the wings of the blades extending from the ferrule.

DETAILED DESCRIPTION OF THE INVENTION

Figure 1:
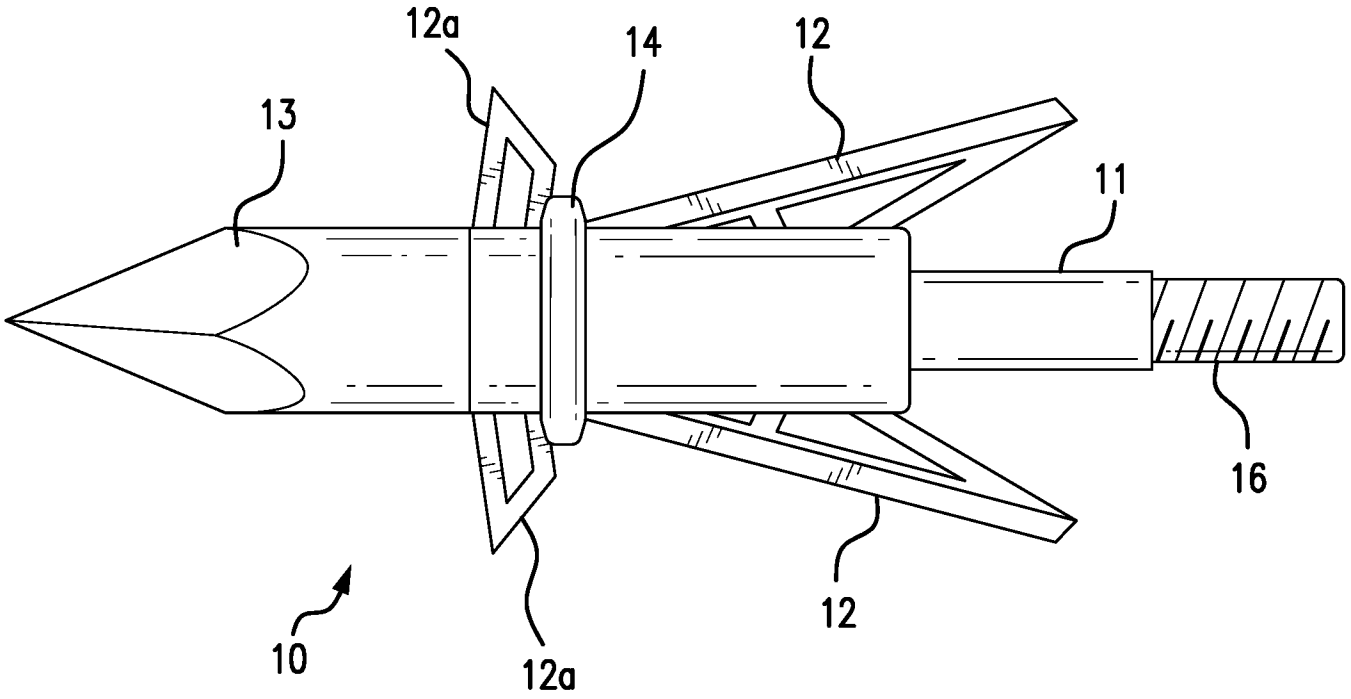
FIG. 1 is a full side view of a highly preferred mechanical broad head of the instant invention affixed with an O-ring with the blades thereof in their folded positon.
Figure 2:
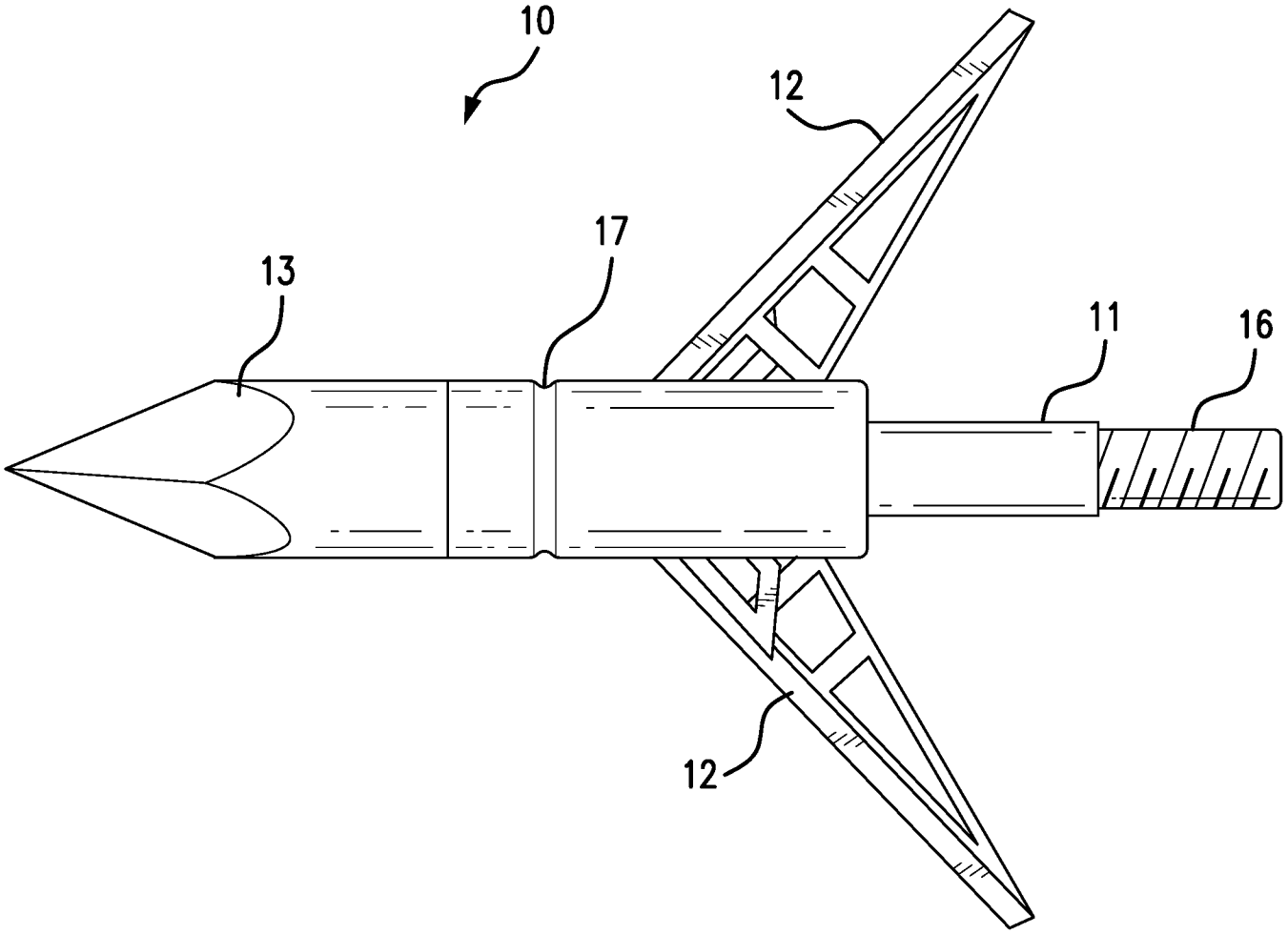
FIG. 2 is a full side view of the embodiment shown in FIG. 1 with the blades thereof in their unfolded position.
Figure 3:
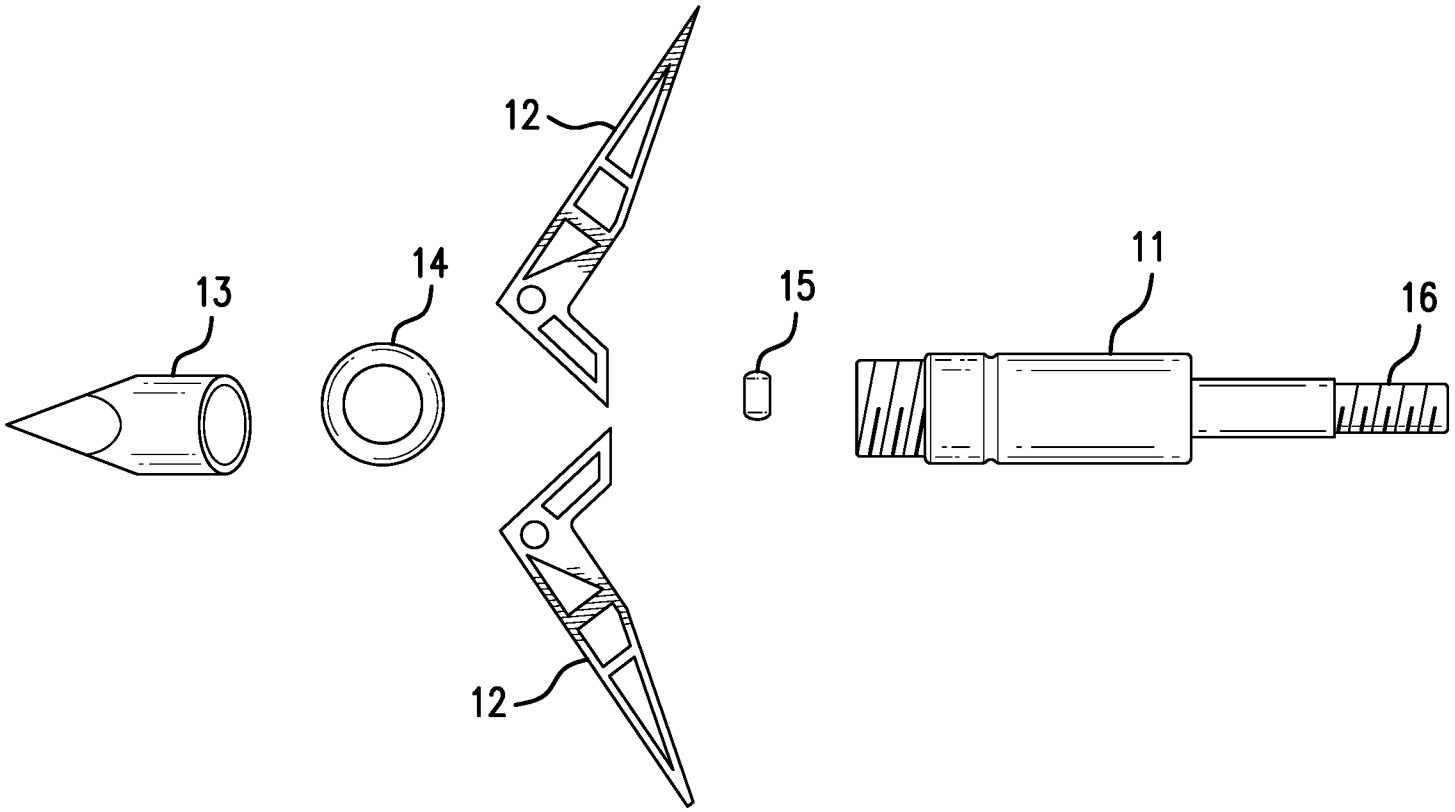
FIG. 3 is a top view of the device of FIG. 1 expanded to show the individual parts.
Figure 4A:
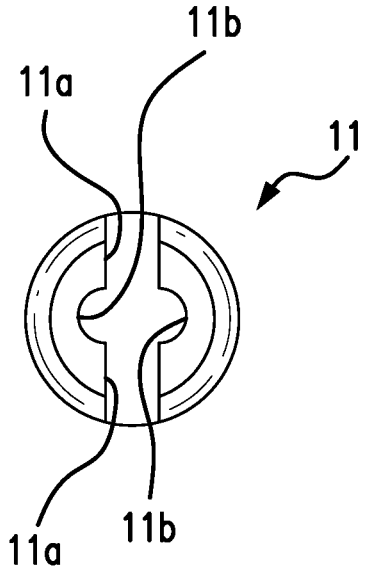
FIG. 4A is a full front view of the ferrule of the embodiment shown in FIG. 1.
Figure 5:
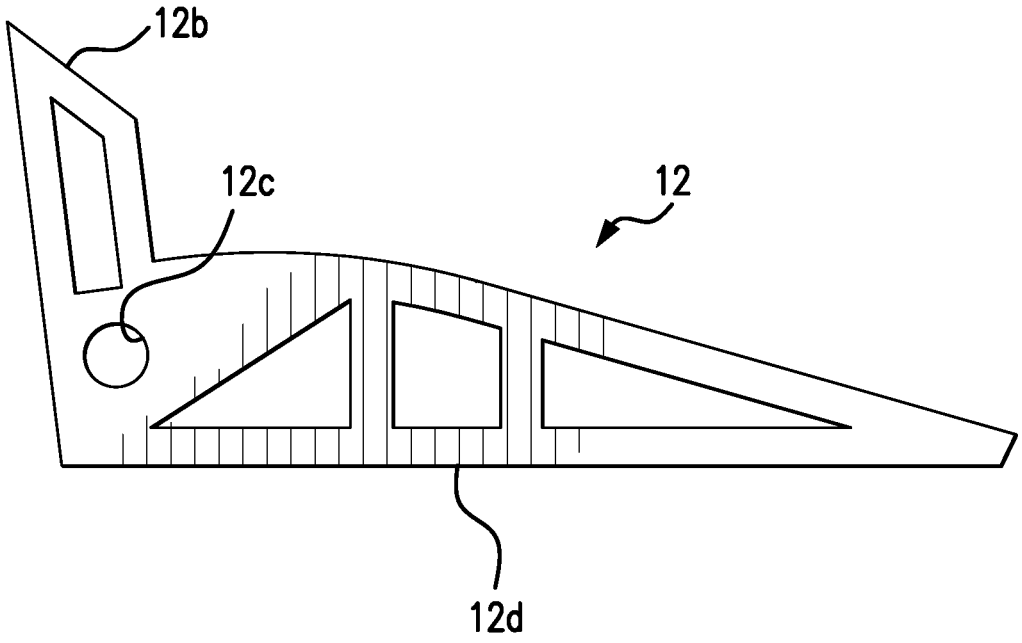
FIG. 5 is a full side view of one of the blades of the embodiment shown in FIG. 1.
Figure 8:
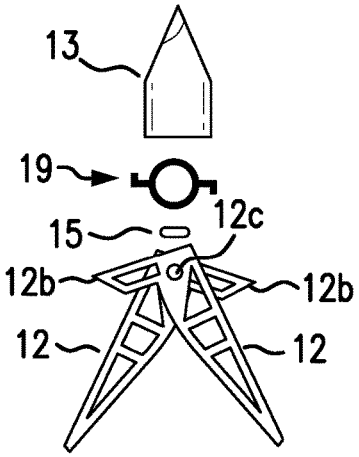
FIG. 8 is a full side view of the device of FIG. 6 in an exploded view to show the various components of the device.
Figure 4B:
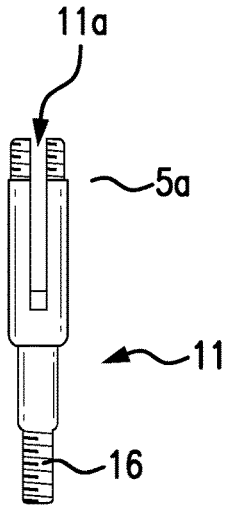
FIG. 4B is a full top view of the ferrule of the device shown in FIG. 1, showing the passageway in phantom.

Referring now to FIG. 1, therein is shown in one embodiment, a highly preferred mechanical broad head 10 of the instant invention with the blades 12 thereof in their folded positon on ferrule 11. Referring now to FIGS. 4A and 4B, ferrule 11 comprises a passageway 11*a* into one end of ferrule 11 along the longitudinal axis of ferrule 11. The other end of ferrule 11 comprises a threaded shank 16 so that ferrule 11 can be screwed into an arrow or crossbow bolt. Ferrule 11 is slotted with slots 11*b* so that when pin 15 shown in FIG. 3 is passed through apertures 12*c* (shown in FIG. 5) of the blades 12 and inserted into passageway 11*a* into ferrule 11, tip 13 shown in FIGS. 1, 2 and 3 can be fastened to the one end of ferrule 11 with blades 12 folded back on ferrule 11 with wings 12*b* of blades 12 extending from ferrule 11. When mechanical broad head 10 penetrates a target, wings 12*b* of blades 12 engage with the target causing blades 12 to swing out from ferrule 11 on pin 15 as pin 15 slides further into ferrule 11 in passageway 11*a* into ferrule 11. Ferrule 11 preferably comprises a groove or channel 17 around a midsection of the ferrule. The groove 17 is for engaging with an elastomeric O-ring 14 shown in FIG. 1 to retain blades 12 folded back on ferrule 11 with wings 12*a* of blades 12 extending from ferrule 11. O-ring 14 is cut by blades 12 when broad head 10 penetrates a target. Referring now to FIG. 5, blade 12 comprises sharpened edge 12*d*.

Figure 6:
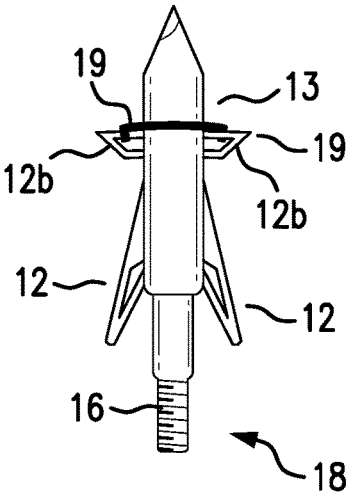
FIG. 6 is a is a full side view of a highly preferred mechanical broad head of the instant invention affixed with a spring lock retainer instead of a rubber O-ring.
Figure 7:
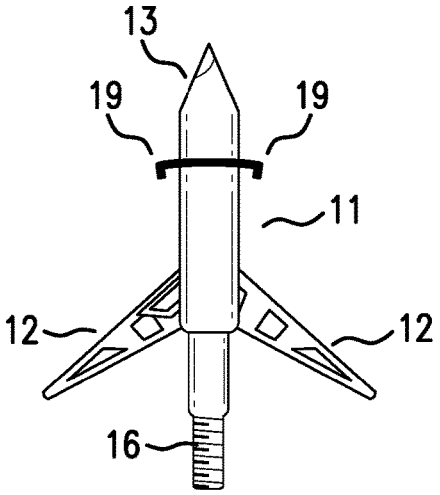
FIG. 7 is a full side view of the embodiment shown in FIG. 6 with the blades thereof in their unfolded position.

In an additional embodiment, a device 18 of this invention is shown in FIG. 6 which is a full side view of a highly preferred mechanical broad head of the instant invention affixed with a spring lock retainer 19 instead of a rubber O-ring. This embodiment does not utilize an O-ring, but instead uses the spring steel lock retainer 19 which holds the wings 12*b* in position until the broad head strikes the target, at which time, the blades 12 release from the spring lock retainer 19 and the blades 12 extend. Otherwise, all components of the device shown in FIG. 6 are the same as the device in FIG. 1.

Figure 9:
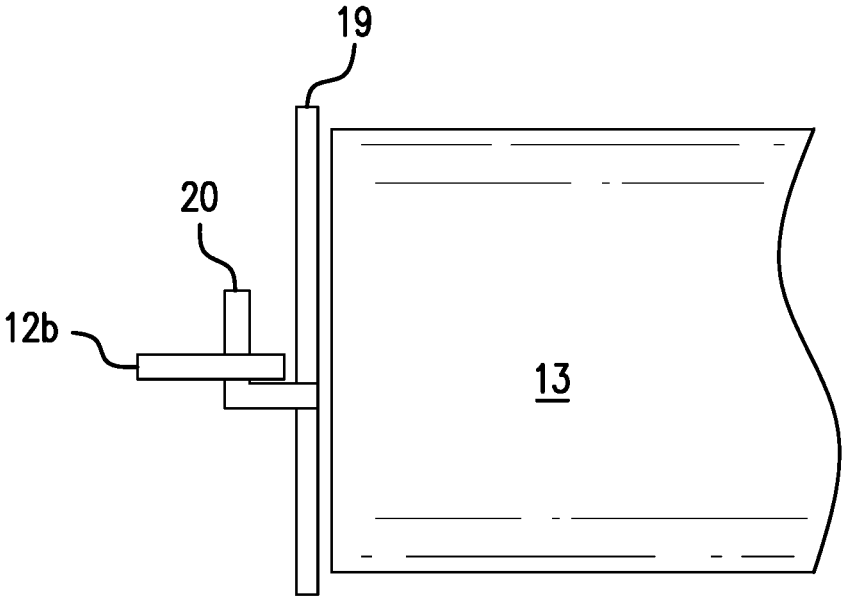
FIG. 9 is an enlarged view of the spring lock retainer attachment to the wing.

FIG. 9 is an enlarged illustration of the connection of the spring lock retainer 19 to the wings 12*b*. The tab 20 of the spring lock retainer 19 engages the wing 12*b* such that the wings 12*b* prevent the blades 12 from releasing from the ferrule 11. When the broad head contacts the target, the spring lock retainer 19 is dislodged from the wing 12*b* and the blades are then free to open.

The components of the instant invention can be made of any suitable material. Preferably the ferrule is made from high strength aluminum. The tip and pin are preferably made of steel. The blades are preferably made of cutlery steel.

The mechanical broad heads of the instant invention are much less complex and can be made at low cost relative to prior art mechanical broad heads. The mechanical broad heads of the instant invention are less likely to fail to operate when a target surface is struck off angle than prior art mechanical broad head. The mechanical broad heads of the instant invention operate more reliably under different conditions of bow strength and target range than prior art mechanical broad heads.

CONCLUSION

While the instant invention has been described above according to its preferred embodiments, it can be modified within the spirit and scope of this disclosure. This application is therefore intended to cover any variations, uses, or adaptations of the instant invention using the general principles disclosed herein. Further, the instant application is intended to cover such departures from the present disclosure as come within the known or customary practice in the art to which this invention pertains.

What is claimed is:

1. A mechanical broad head, comprising: two blades a tip and a ferrule, each blade having a wing and an aperture, the ferrule comprising a passageway into one end of the ferrule along the longitudinal axis of the ferrule dimensioned to accept a pin having a longitudinal axis transverse to the longitudinal axis of the ferrule so that when the pin is passed through the apertures of the blades and inserted into the passageway into the ferrule, the tip can be fastened to the one end of the ferrule with the blades folded back on the ferrule with the wings of the blades extending from the ferrule so that when the mechanical broad head penetrates a target, the wings of the blades engage with the target causing the blades to swing out from the ferrule on the pin as the pin slides further into the ferrule in the passageway into the ferrule, said mechanical broad head further comprising a spring lock retainer to retain the blades folded back on the ferrule with the wings of the blades extending from the ferrule.

* * * * *